United States Patent [19]

Zehren

[11] 4,003,428

[45] Jan. 18, 1977

[54] APPARATUS AND METHOD FOR UNDERWATER PUMP INSTALLATION

[75] Inventor: James N. Zehren, Bartlesville, Okla.

[73] Assignee: TRW Inc., Cleveland, Ohio

[22] Filed: Sept. 19, 1975

[21] Appl. No.: 615,100

[52] U.S. Cl. ..... 166/.5; 166/65 R

[51] Int. Cl.[2] ..... E21B 7/12

[58] Field of Search ..... 166/.5, .6, 60, 65, 166/68.5, 72, 82, 85, 86, 315; 175/7

[56] References Cited

UNITED STATES PATENTS

| | | | |
|---|---|---|---|
| 3,025,916 | 3/1962 | Frick | 175/7 |
| 3,095,627 | 7/1963 | Johnson | 166/82 X |
| 3,311,063 | 3/1967 | Grable | 166/.5 |
| 3,315,741 | 4/1967 | Triplett | 166/.5 |
| 3,332,484 | 7/1967 | Watkins | 166/.6 |
| 3,380,520 | 4/1968 | Pease | 166/.5 |
| 3,412,789 | 11/1968 | Ralph et al. | 166/75 X |
| 3,556,209 | 1/1971 | Reistle et al. | 166/.5 |
| 3,638,732 | 2/1972 | Huntsinger et al. | 166/315 |
| R26,290 | 10/1967 | Rand | 175/7 X |

*Primary Examiner*—Ernest R. Purser
*Assistant Examiner*—Richard E. Favreau
*Attorney, Agent, or Firm*—Shapiro and Shapiro

[57] ABSTRACT

A submergible pump assembly is installed in an underwater wellhead and rendered operable without the use of divers. A hose is guided down a cable extending upwardly from the wellhead and is inserted in a wellhead entry horn. The pump assembly is then lowered through the hose and into an upright tube in the wellhead. The pump assembly is locked in position in the tube and is connected to electrical power lines by remotely controlled hydraulic actuators in a sealed housing adjacent to the tube, the locking of the pump assembly also sealing the assembly in the tube concurrently. After the pump assembly has been installed, the hose and a running and retrieving tool in the hose are removed from the wellhead.

21 Claims, 7 Drawing Figures

APPARATUS AND METHOD FOR UNDERWATER PUMP INSTALLATION

BACKGROUND OF THE INVENTION

This invention is concerned with underwater pump installations and is more particularly concerned with apparatus and methods for installing a submergible pump assembly in an underwater wellhead.

World-wide demand for oil and gas has greatly stimulated the drilling and operating of subsea wells. Extensive prior art has therefore evolved with respect to the introduction and installation of equipment in underwater wellheads. See, for example, the following U.S. Pat. Nos.:

| | | | |
|---|---|---|---|
| Huntsinger et al | 3,638,732 | Burrus | 3,455,114 |
| Petersen | 3,604,731 | Dean | 3,293,867 |
| Ralph et al | 3,412,789 | Laffont et al | 3,511,312 |
| Morrill | 3,741,294 | Culver et al | 3,101,118 |
| Johnstone et al | 3,285,337 | Yetman | 3,312,282 |
| Brown | 3,605,884 | Herd | 3,678,996 |
| Wakefield, Jr. | 3,662,822 | Delacour et al | 3,538,238 |
| Talley, Jr. | 3,638,722 | | |

One of the problems treated in the prior art is the installation of a submergible pump assembly in an underwater wellhead. Various techniques have been proposed. For example, in the aforesaid U.S. Pat. No. 3,638,732, the pump assembly is suspended by cable from the underwater production tree, but the establishment of electrical connections to the pump assembly requires the services of a diver. In general, prior art techniques for installing submergible pump assemblies in underwater wells suffer from one or more of the following deficiencies: complexity, high cost, inefficiency, unreliability, exposure of the pump assembly to damage, insecure mounting and inadequate sealing of the pump assembly in the wellhead, and exposure of the installation apparatus to sea water.

BRIEF DESCRIPTION OF THE INVENTION

Accordingly, a principal object of the present invention is to provide improved apparatus and methods for installing submergible pump assemblies in underwater wellheads.

Briefly stated, in accordance with a preferred embodiment of the invention a submergible pump assembly is lowered into an underwater wellhead through a hose that has previously been guided from the surface of a body of water along a cable and into an entry horn of the wellhead. The pump assembly is seated on and suspended from a shoulder in an upright wellhead tube that is vertically aligned with a well bore below the wellhead. A housing adjacent to the tube and sealed from the body of water contains hydraulic actuators for locking a suspension head of the pump assembly in the tube and for establishing electrical connections to the pump assembly. The locking of the pump assembly in the tube also seals the assembly in the tube concurrently. After the pump assembly has been installed, the hose and a running and retrieving tool are removed.

BRIEF DESCRIPTION OF THE DRAWINGS

The invention will be further described in conjunction with the accompanying drawings, which illustrate preferred and exemplary embodiments, and wherein.

DETAILED DESCRIPTION OF THE INVENTION

Figure 1:
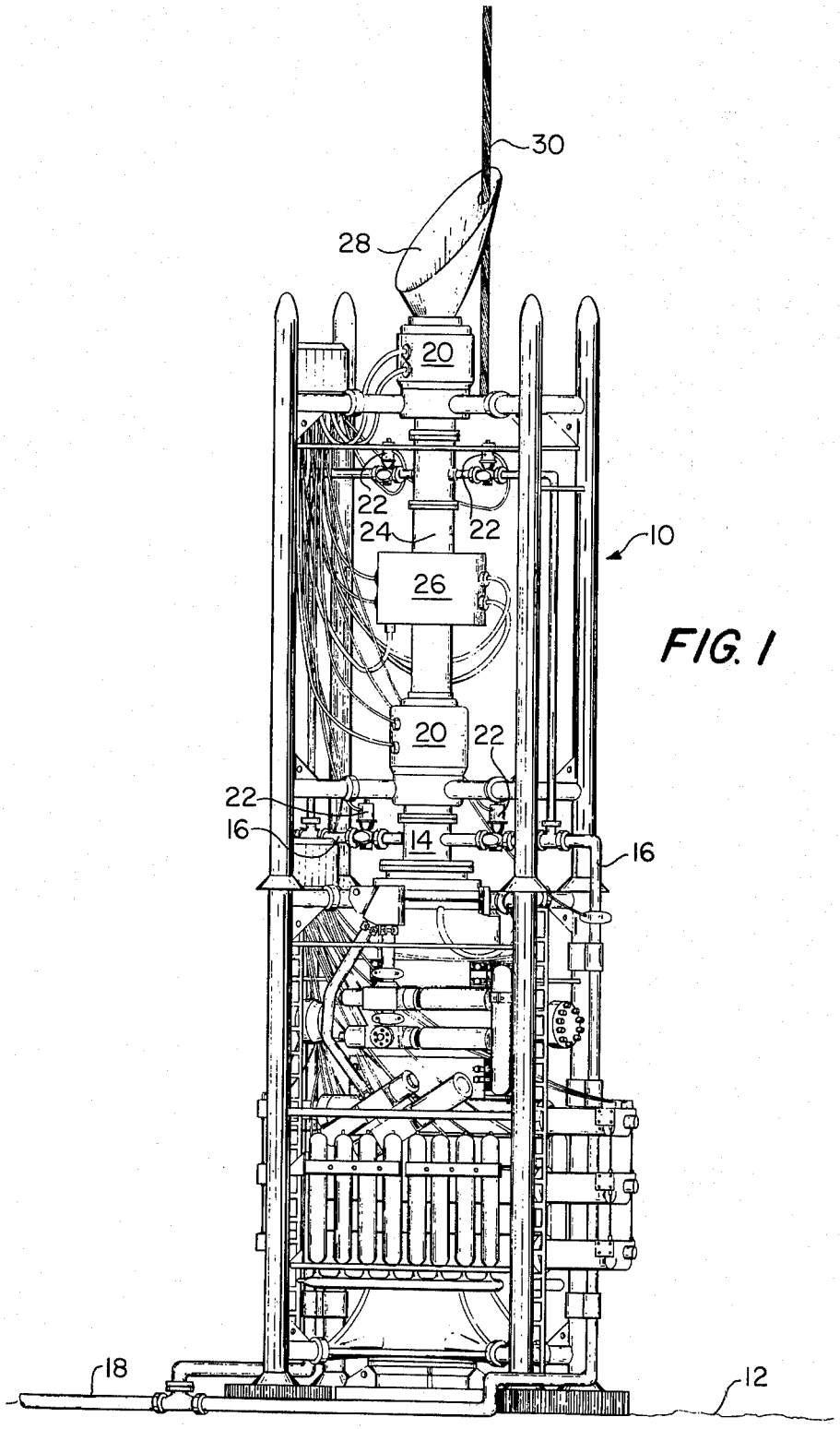
FIG. 1 is a side elevation view of an underwater wellhead incorporating apparatus of the invention; invention; 2 is a fragmentary, somewhat diagrammatic elevation view illustrating a first step in accordance with an installation method of the inventio n.

Referring to the drawings, and initially to FIG. 1 thereof, reference numeral 10 designates a typical underwater wellhead. The wellhead apparatus is installed on the bed 12 at the bottom of a body of water such as the sea, and a well bore extends downwardly from the wellhead, as will be described later. Fluid, such as oil or gas, is pumped upwardly from the well bore into the production tree 14 of the wellhead and then via pipes 16 and 18 is transported to the shore or to a production platform, for example. Except for the structures to be described hereinafter in connection with the invention, the wellhead apparatus may be any appropriate conventional type, the details of which are not important to the present description. In the form shown the wellhead apparatus includes bag-type blow-out preventers 20 and remotely controlled valves 22 for bleeding pressure during pulling of the pump assembly, for example. The parts of the wellhead apparatus particularly pertinent to the invention include a vertical tube or riser 24, a housing 26, an entry funnel or horn 28, and a cable 30, all of which will be referred to more fully hereinafter.

Figure 2:
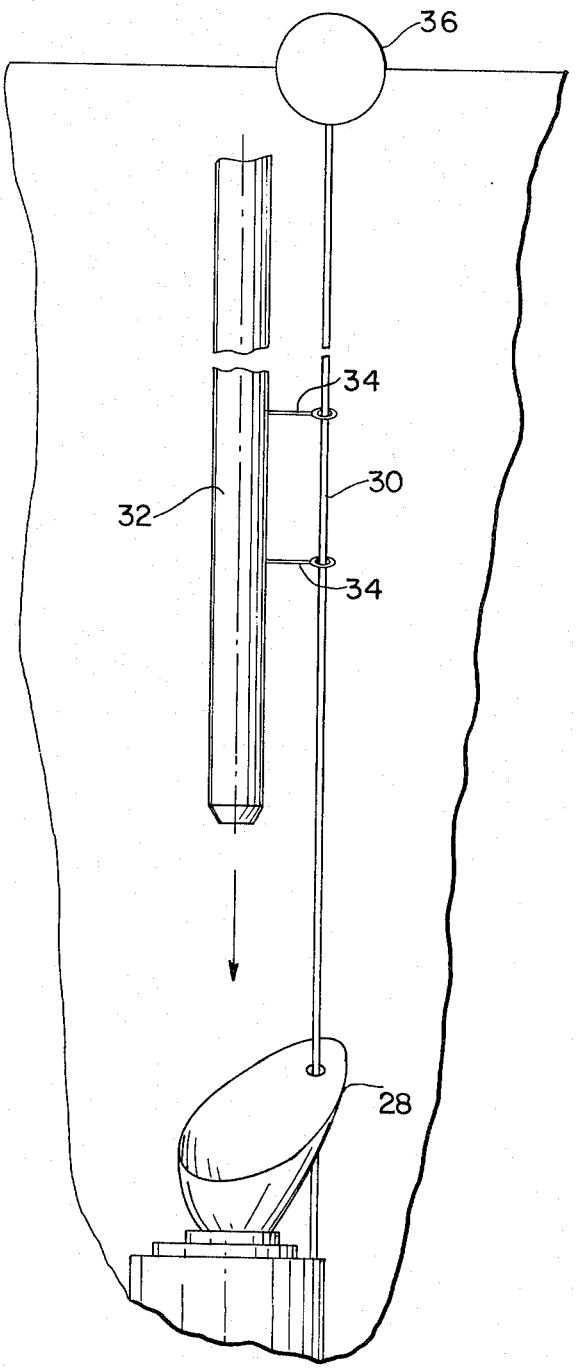

In accordance with a preferred installation method of the invention, and as shown in FIG. 2, a flexible hose 32, which may be of rubber with a metal tip at the lower end, for example, is guided along cable 30 by means of conventional guides 34, only two of which are shown for illustrative purposes. The cable extends upwardly from the horn 28 to a buoy 36, which may normally float submerged and which may be summoned to the surface (paying out cable therefrom automatically) in response to radio or sonic signals, as is well known in the art. The guides 34 of the hose 32 may then be coupled to the cable 30 (by means of split rings, for example) and the hose may then be lowered along the cable from a ship or platform (not shown).

Figure 3:
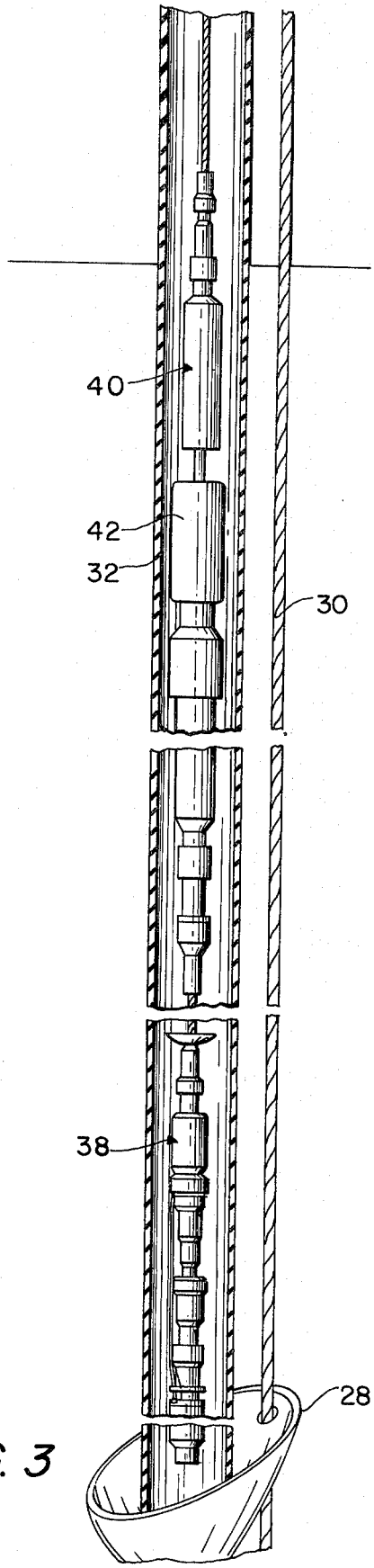
FIG. 3 is a similar, partly sectional view illustrating a second step.
Figure 4:
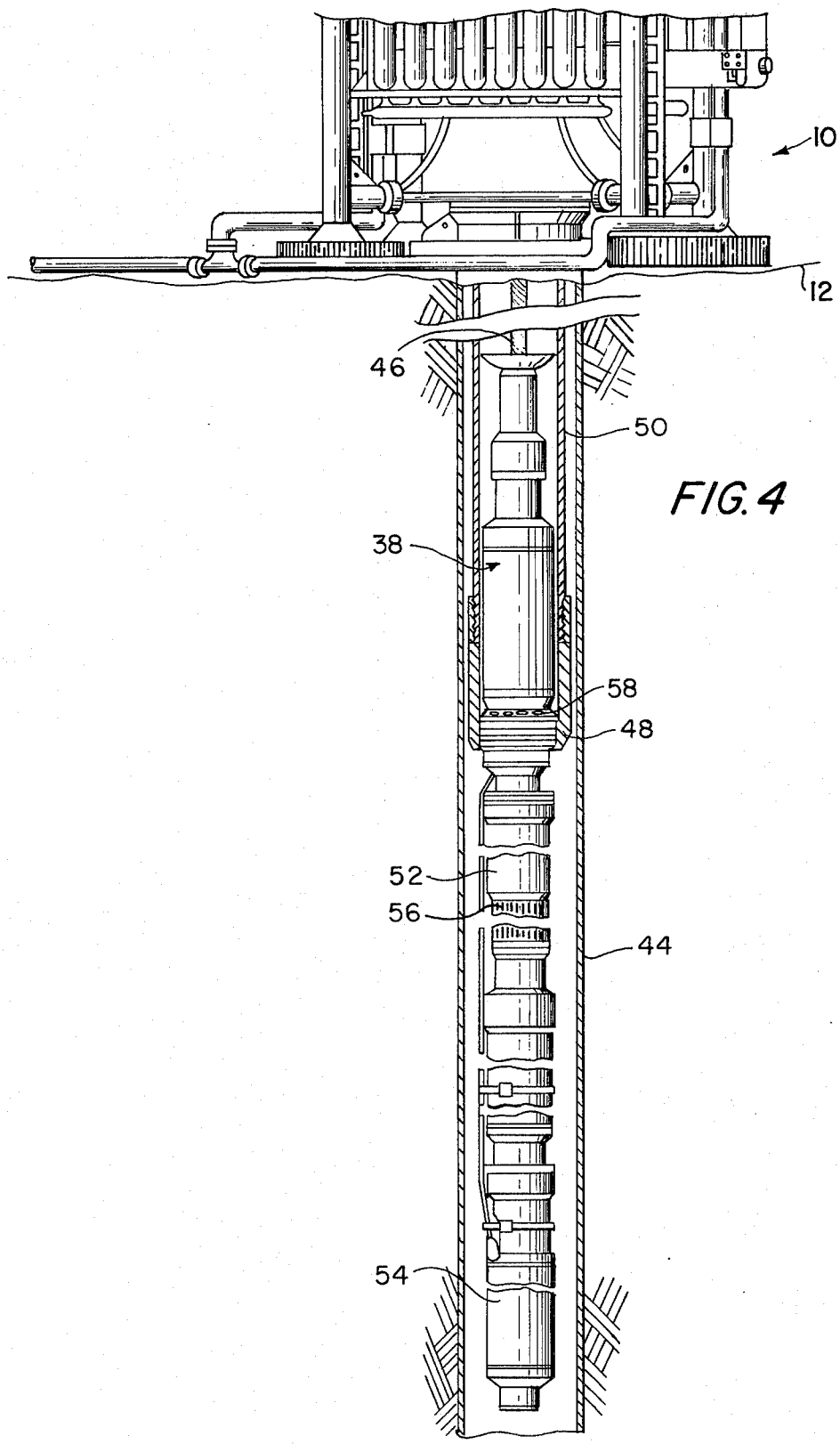
FIG. 4 is a fragmentary vertical sectional view illustrating a submergible pump assembly installed in an underwater well.

After the hose has entered the horn 28, a submergible pump assembly 38 may then be lowered through the hose 32 by means of a cable-suspended running and retrieving tool 40, as shown in FIG. 3. Tool 40 is releasably coupled to a suspension head 42 of the pump assembly, as will be described later. The pump assembly, except for the suspension head to be described, may be of a conventional submergible type, such as the well-known cable-suspended submergible pump assemblies manufactured and sold by Reda Pump Division of TRW, Inc., one example of which is shown and described in U.S. Pat. No. 3,672,795 to Arutunoff et al. FIG. 4 illustrates the pump assembly 38 installed in a well bore 44 extending downwardly beneath the wellhead 10. In the form shown the pump assembly is lowered by a cable 46 onto a shoe 48 at the bottom of a liner 50 extending downwardly from the wellhead. The submergible pump 52 is driven by an electric motor 54, fluid from the well bore entering the intake head 56 and being pumped through the discharge head 58 into the liner 50 and via the liner to the production tree 14 of the wellhead. It will be appreciated, however, that the pump assembly may be supported upon a packer in the casing of the well bore and that the discharge of the pump may be transported to the wellhead via the casing or a discharge tubing string. Except for the portion in the wellhead, the details of the pump assembly are not important to the present invention.

Figure 5:
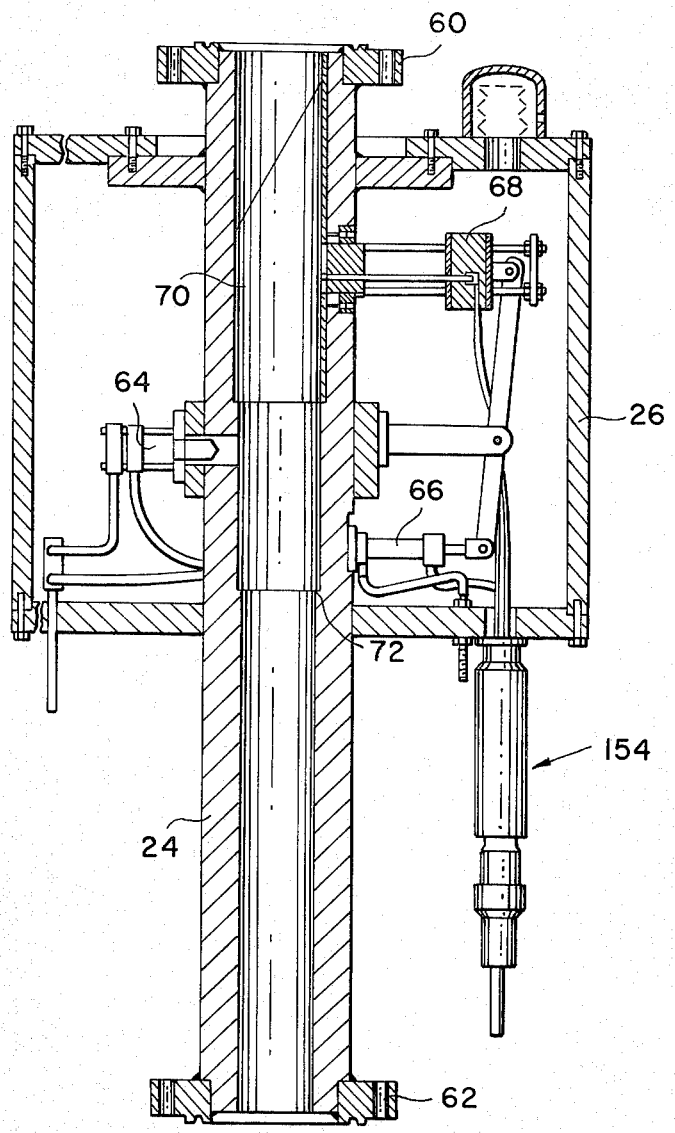
FIG. 5 is a vertical sectional view illustrating apparatus in the wellhead for installing the pump assembly.

It now remains to describe the manner in which the pump assembly is installed in the wellhead after passing through the hose 32 as shown in FIG. 3. FIG. 5 illustrates the tube 24 and the housing 26 previously referred to in connection with FIG. 1. The upper flanged end 60 of tube 24 communicates with the horn 28, and the lower flanged end 62 of tube 24 communicates with the production tree. Housing 26 preferably surrounds tube 24, and the chamber within the housing is sealed to prevent the admission of water from the surrounding body. Suitable seals are provided between juxtaposed separable parts of the housing which are releasably fastened together to permit access to the interior of the housing when desired. Mounted within the housing are hydraulic actuators 64 and 66 and a reciprocating carriage 68. These elements and associated parts as well as an orienting sleeve 70 and a suspension shoulder 72 in tube 24 and other parts will now be referred to in greater detail with respect to FIGS. 6*a* and 6*b*.

Figure 6A:
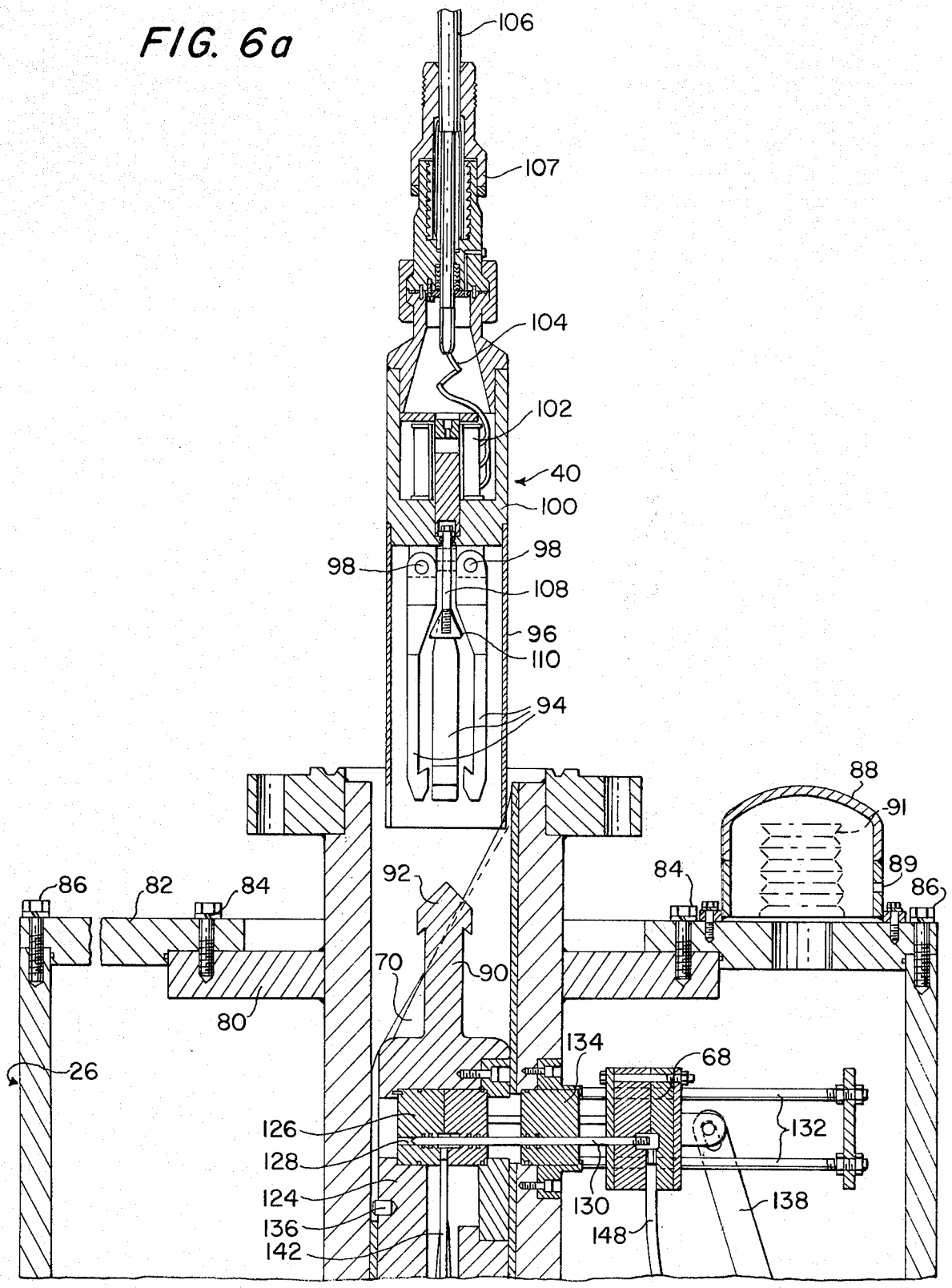
FIGS. 6*a* and 6*b* are fragmentary vertical sectional views, which, taken together, illustrate the apparatus of FIG. 5, but with a pump assembly installed therein and shown in conjunction with a running and retrieving tool.
Figure 6B:
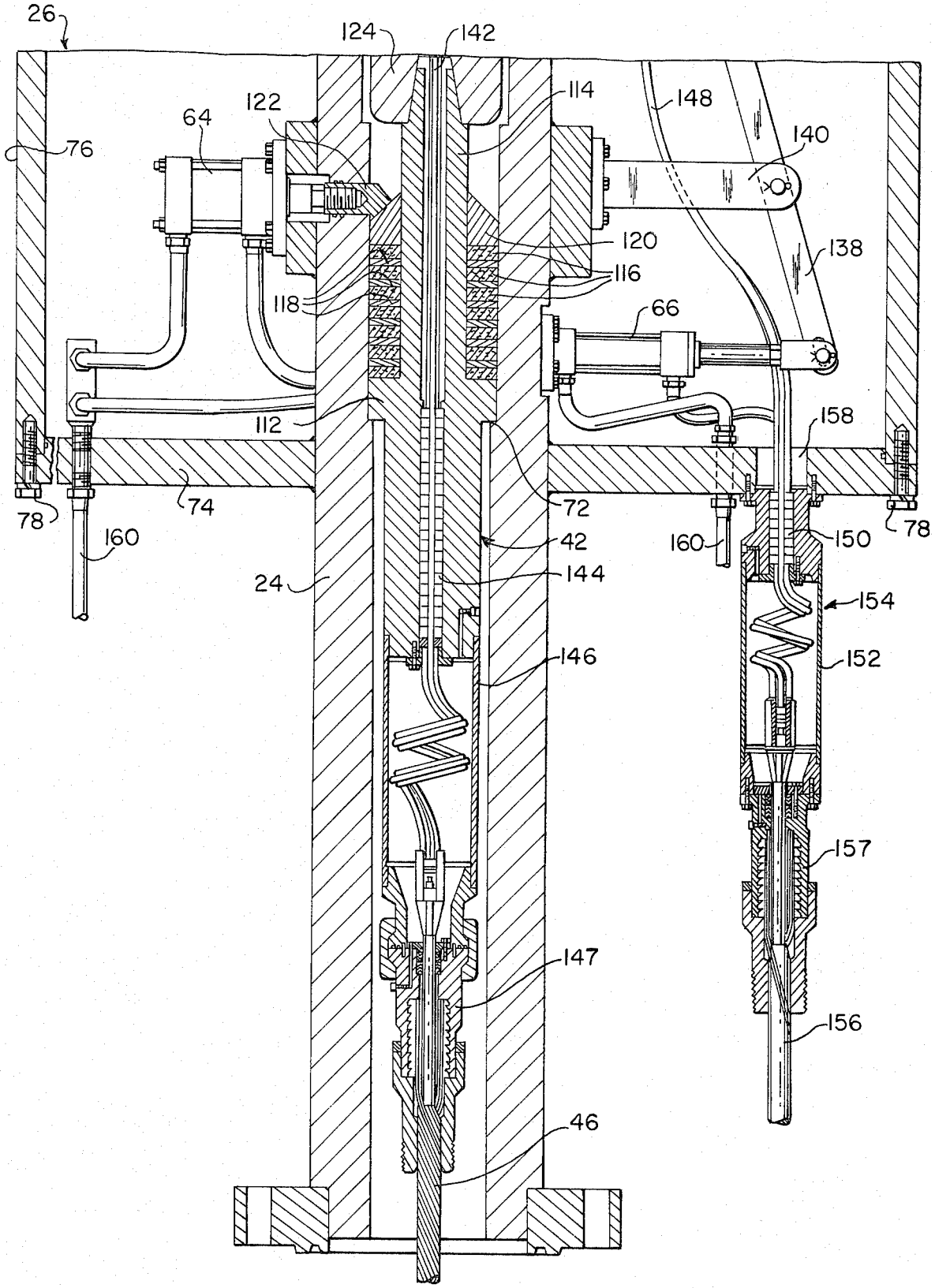

FIGS. 6*a* and 6*b* illustrate the apparatus of FIG. 5 upon completion of the pump assembly installation. The view has been split into two parts, with FIG. 6*a* showing the upper half of the apparatus and FIG. 6*b* the lower half, in order to illustrate the apparatus in greater detail. It can now be seen that the housing 26, which may be cylindrical, may comprise a bottom wall 74 welded to tube 24 and having a central opening through which the tube extends, a side wall 76 secured to the bottom wall by means of bolts 78, and a top wall comprising an inner portion 80 welded to pipe 24 and having a central opening through which the tube extends and an outer portion 82 secured to the inner portion by means of bolts 84 and secured to the side wall 76 by means of bolts 86. As noted previously, the separable parts of the housing are provided with appropriate seals therebetween to prevent the admission of water. The housing is preferably provided with a pressure equalizing device 88, which may comprise a chamber containing a conventional expansion bag or similar device shown in phantom at 91, one side of which communicates with the space within housing 26 and the other side of which communicates with the surrounding body of water via port 89. Thus, if the housing is pressurized, the pressure within the housing will be equalized with respect to the pressure outside of the housing, minimizing leakage.

The suspension head 42 of the pump assembly has a fishing and landing neck 90 with an enlarged tip 92 releasably engageable with hooks 94 of the running and retrieving tool 40. As shown, the tool may comprise a casing 96 surrounding the hooks 94, which may be pivotally suspended at 98 from a main body 100 of the tool containing an actuating coil 102. When the coil is de-energized, hooks 94 (there being three or four hooks, for example arranged around the circumference of a circle) are spring biased to the position shown, so that they may be snapped over the tip 92 of the fishing and landing neck 90 to grip the neck. When the coil 102 is energized via electric conductors 104 forming part of the suspension cable 106 (coupled to main body 100 by cable coupling 107), a plunger 108 is drawn into the coil, engaging a cam 110 with inclined inner surfaces of hooks 94, turning the hooks outwardly to release the tip 92. During the lowering or raising of the pump assembly through the hose 32, the hooks will of course be engaged with the fishing and landing neck of the pump assembly. After the pump assembly has been placed in the wellhead, the hooks will be released from the fishing and landing neck, and the running and retrieving tool 40 will be withdrawn, and the hose 32 also, as previously described.

Shoulder 72 mentioned in connection with FIG. 5 is preferably an annular seat for the annular base 112 of the suspension head 42. The suspension head has a stem 114 extending upwardly from the base and supporting a stack of elastomeric sealing washers 116 alternating with disc spacers 118, all of which are supported freely on the stem. The top of the stack is capped by a cam ring 120 having an inclined surface at the top thereof engageable with a correspondingly inclined surface of a plurality of locking bolts 122, only one of which is shown. Preferably three or four locking bolts are arranged around the circumference of tube 24, and each may have its own hydraulic actuator 64, or the bolts may be operated conjointly by a single actuator 64. The bolts reciprocate in radial bores through the wall of tube 24, and before installation of the pump assembly are retracted from the tube as shown in FIG. 5. After the pump assembly has been seated upon the shoulder 72, the bolts are projected by actuators 64 into the tube 24 to engage the cam ring 120 and urge the ring downwardly toward the base 112, compressing the washers 116 therebetween. The vertical compression of the washers causes horizontal expansion, engaging the circumference of the washers with the inner surface of tube 24 to form a tight seal between the suspension head of the pump assembly and the inner surface of tube 24. By this arrangement the pump assembly is simultaneously securely locked in the wellhead and sealed therein, preventing any loss of pumped fluid out of the top of tube 24 and preventing any possibility of the lifting of the pump assembly from seat 72 under increased bottom hole pressure. It will be recalled that the discharge of the pump is carried away from the production tree 14 below tube 24.

In order to operate the pump it is necessary to establish electrical connections to the motor 54. For this purpose the main body 124 of the suspension head contains a terminal block 126 having a plurality of horizontally oriented female connectors 128, only one of which is shown, for clarity of illustration. Male connectors 130 in the form of elongated pins projecting from carriage 68 are received in the corresponding female connectors 128, one or more openings being provided in the side of main body 124 to permit the insertion of the male connectors. Carriage 68 is supported for reciprocation on a track 132 mounted on the wall of tube 24. Reciprocative movement of the male connectors 130 is guided by the guide block 134 mounted in and sealed in the wall of tube 24. A conventional orienting sleeve 70 mentioned in connection with FIG. 5 cooperates with a locating pin 136 on the suspension head to provide proper orientation of the female connectors for receipt of the male connectors. AS is well known, the orienting sleeve may have an opening with converging edge surfaces to constrain the pin 136 to follow a predetermined path when the pump assembly is lowered into the wellhead. Carriage 68 is moved by hydraulic actuator 66 via a linkage including a lever 138, the lower end of which is pivotally connected to the hydraulic actuator, the upper end of which is pivotally connected to carriage 68, and a central portion of which is pivotally mounted upon a bracket 140 projecting from the outer surface of tube 24 as shown.

The female connectors 128 are electrically connected to the pump motor by corresponding conductors 142 extending downwardly through a packing chamber 144 to a cable connecting chamber 146 of the suspension head 42. By means of a chamber 146 the conductors are connected to corresponding conductors forming a part of the cable 46 (which is coupled to chamber 146 by cable coupling 147). The male connectors 130 are electrically connected to flexible conductors 148 which extend through a packing chamber 150 to a cable connecting chamber 152 of a cable coupling 154. By this arrangement electrical connections are established between the male connectors 130 and the conductors of an electrical cable 156, which is coupled to chamber 152 by cable coupling 157 and which leads to a source of electric power at shore or a platform, for example, these connections being established via a sealed opening 158 in housing 26. Since the hydraulic lines 160 (which are supplied from the shore or a platform) also enter housing 26 via sealed openings, isolation of the interior of the housing from the surrounding water is maintained. Seals are also provided around the bolts 122, between the terminal block 126 and the main body 124 of the suspension head, between guide block 134 and the wall of tube 24, and between the male connectors 130 and the inner surfaces of the corresponding bores of blocks 126 and 134.

By virture of the invention the submergible pump assembly is readily installed in an underwater well. The pump assembly is guided and protected during movement from the surface to the wellhead, and after the assembly has been installed the guide hose and running and retrieving tool are readily removed, so that the water above the wellhead is free of obstruction. The pump assembly is securely locked in the wellhead and is sealed therein concurrently. This operation and the establishment of electrical connections are accomplished semi-automatically without requiring divers. Moreover, the operating parts are sealed against the corrosive effects of water, and well fluid also, and are thus capable of operating over long periods of time without maintenance.

While preferred embodiments of the invention have been shown and described, it will be apparent to those skilled in the art that changes can be made without departing from the principles and spirit of the invention, the scope of which is defined in the following claims.

I claim:

1. Underwater wellhead apparatus comprising a tube having means for supporting the same upright above and in communication with a well bore extending below a body of water, means including a pump assembly suspension head for suspending a submergible pump assembly in said tube at an operating position, a housing adjacent to said tube and having its interior isolated from said body of water, and means in said housing for locking said suspension head in said tube.

2. Apparatus in accordance with claim 1, wherein said locking means has means for remote control thereof.

3. Apparatus in accordance with claim 2, wherein said remote control means comprises hydraulic actuator means in said housing.

4. Underwater wellhead apparatus comprisng a tube having means for supporting the same upright above and in communication with a well bore extending below a body of water, means for suspending a submergible pump assembly in said tube, a housing adjacent to said tube and having its interior isolated from said body of water, means in said housing for locking said pump assembly in said tube, said locking means comprising bolt means movable into said tube to engage a portion of said pump assembly, said suspending means comprising a shoulder in said tube and a suspension head of said pump assembly with base means for supporting the suspension head on said shoulder, and said bolt means engaging said suspension head.

5. Apparatus in accordance with claim 4, wherein said suspension head has means actuated by said bolt means for sealing said suspension head in said tube.

6. Apparatus in accordance with claim 5, wherein said suspension head has a central stem extending from said base means along said tube and wherein said sealing means comprises washer means supported on said base means and surrounding said stem and means actuated by said bolt means for compressing said washer means against said base means and causing said washer means to expand against the inner surface of said tube.

7. Apparatus in accordance with claim 6, wherein said washer means comprises a stack of elastomeric washers alternating with spacers, there being a cam ring at the top of said stack engaged by said bolt means.

8. Underwater wellhead apparatus comprising a tube having means for supporting the same upright above and in communication with a well bore extending below a body of water, means for suspending a submergible pump assembly in said tube, a housing adjacent to said tube and having its interior isolated from said body of water, means in said housing for locking said pump assembly in said tube, and means in said housing for establishing electrical connections to said pump assembly.

9. Apparatus in accordance with claim 8, wherein said establishing means has means for the remote control thereof.

10. Apparatus in accordance with claim 9, wherein said remote control means comprises hydraulic actuator means.

11. Apparatus in accordance with claim 8, wherein said establishing means comprises female connector means on said pump assembly and male connector means movable into said tube to engage said female connector means.

12. Apparatus in accordance with claim 11, further comprising cooperating means in said tube and on said pump assembly for automatically orienting said pump assembly to align said female connector means with said male connector means.

13. Apparatus in accordance with claim 11, wherein said establishing means comprises a carriage supporting said male connector means for movement laterally of said tube, and actuator means in said housing for moving said carriage.

14. Apparatus in accordance with claim 13, further comprising electric conductor means extending through a sealed opening in a wall of said housing to said male connector means.

15. Underwater wellhead apparatus comprising a tube having means for supporting the same upright above and in communication with a well bore extending below a body of water, means for suspending a submergible pump assembly in said tube, a housing adjacent to said tube and having its interior isolated from said body of water, means in said housing for locking said pump assembly in said tube, said housing having means for equalizing the pressure in said housing with respect to the pressure exterior to said housing.

16. Underwater wellhead apparatus comprising a tube having means for supporting the same upright above and in communication with a well bore extending below a body of water, means for suspending a submergible pump assembly in said tube, a housing adjacent to said tube and having its interior isolated from said body of water, means in said housing for locking said pump assembly in said tube, and means for introducing said pump assembly into said tube, said introducing means comprising a horn, a cable extending away from said horn, a hose having means for guiding the same along said cable and into said horn, and means for lowering said pump assembly through said hose and into said horn and said tube.

17. Apparatus in accordance with claim 16, wherein said lowering means comprises a cable-suspended tool releasably engageable with said pump assembly.

18. Apparatus for installing a pump assembly in an underwater wellhead having an entrance horn, said apparatus comprising a cable extending away from said horn, a hose having means for guiding the same along said cable and into said horn, and means for lowering said pump assembly through said hose and into said horn.

19. Underwater wellhead apparatus comprising a tube having means for supporting the same upright above and in communication with a well bore extending below a body of water, means including a submergible pump suspension head for suspending a submergible pump assembly in said tube at an operating position, a housing adjacent to said tube and having its interior isolated from said body of water, sealing means actuatable for sealing said suspension head in said tube and means in said housing for actuating said sealing means.

20. A method of installing a pump assembly in an underwater wellhead through an entrance horn thereof, which comprises extending a cable upwardly from said horn, coupling a hose to the upper end of said cable, moving said hose along said cable and into said horn, lowering the pump assembly through said hose and into said wellhead by means of a cable-suspended tool releasably coupled to said pump assembly, seating said pump assembly in said wellhead, releasing said tool from said pump assembly, and removing said hose and said tool from said wellhead.

21. A method in accordance with claim 20, further comprising sealing said pump assembly in said wellhead and establishing electrical connections thereto.

* * * * *